US012760478B2

(12) United States Patent
Menzenbach

(10) Patent No.: US 12,760,478 B2
(45) Date of Patent: Oct. 13, 2026

(54) SELF-PROPELLED CONSTRUCTION MACHINE FOR WORKING THE GROUND

(71) Applicant: Wirtgen GmbH, Windhagen (DE)

(72) Inventor: Christoph Menzenbach, Neustadt (DE)

(73) Assignee: Wirtgen Gmbh, Windhagen (DE)

( * ) Notice: Subject to any disclaimer, the term of this patent is extended or adjusted under 35 U.S.C. 154(b) by 178 days.

(21) Appl. No.: 18/610,481

(22) Filed: Mar. 20, 2024

(65) Prior Publication Data

US 2024/0328098 A1 Oct. 3, 2024

(30) Foreign Application Priority Data

Mar. 28, 2023 (DE) ..... 10 2023 107 779.1

(51) Int. Cl.
*E01C 23/088* (2006.01)
*E01C 19/00* (2006.01)

(52) U.S. Cl.
CPC ..... *E01C 23/088* (2013.01); *E01C 19/004* (2013.01)

(58) Field of Classification Search
CPC ..... E01C 19/004; E01C 21/00
See application file for complete search history.

(56) References Cited

U.S. PATENT DOCUMENTS 5,190,398 A * 3/1993 Swisher, Jr. ..... B62D 33/0633 173/24
9,777,443 B2 10/2017 Bornemann et al.
9,797,100 B1 10/2017 Muir et al.
2005/0199120 A1* 9/2005 Bitter ..... F15B 11/0445 91/446
2008/0093145 A1* 4/2008 Matsuyama ..... F02D 31/009 701/84
2013/0341996 A1* 12/2013 Franzmann ..... E01C 23/088 299/1.5
2014/0277988 A1* 9/2014 Franganillo ..... G01N 7/14 701/93
2015/0204029 A1* 7/2015 Bornemann ..... E01C 19/26 404/84.1
2018/0112528 A1* 4/2018 Müller ..... E01C 23/088

FOREIGN PATENT DOCUMENTS

DE 3921875 A1 1/1991
DE 102014201240 A1 7/2015
DE 102017110146 A1 11/2017

* cited by examiner

*Primary Examiner* — Scott A Browne
*Assistant Examiner* — Josephine Rich
(74) *Attorney, Agent, or Firm* — Gary L. Montle; Lucian Wayne Beavers; Patterson Intellectual Property Law, PC

(57) ABSTRACT

A self-propelled construction machine for working the ground, in particular a stabilizer or recycler, has a controller for automatically reversing the direction of travel, which interacts with the drive device for the wheels or crawler tracks. The controller is configured such that the drive device, after receiving a travel direction reversal control signal, reduces the predefined first speed at which the construction machine travels in the first direction of travel until the construction machine is stationary, and, after the construction machine is stationary, drives the wheels or crawler tracks in the opposite direction, wherein the drive device increases the speed in the second direction of travel up to a predetermined second speed. Not only the drive device, but also other components of the construction machine, may be automatically controlled depending on different driving situations.

10 Claims, 14 Drawing Sheets

SELF-PROPELLED CONSTRUCTION MACHINE FOR WORKING THE GROUND

CROSS-REFERENCES TO RELATED APPLICATIONS

This application claims the benefit of German Patent Application No. DE 10 2023 107 779.1, filed Mar. 28, 2023, and which is hereby incorporated by reference.

FIELD OF THE INVENTION

The present disclosure relates to a self-propelled construction machine for working the ground, in particular a stabilizer or recycler.

BACKGROUND

In order to stabilize insufficiently stable ground, stabilizers with which a powdered or liquid binder is introduced into the ground in order to increase its load-bearing capacity are known. The known recyclers differ from stabilizers in that recyclers serve not only to improve or solidify the ground, but also to repair damaged cover layers of roads or paths.

Stabilizers or recyclers have a machine frame supported by wheels or crawler tracks standing on the ground, and a roller housing arranged on the machine frame, in which a rotatable milling/mixing roller for working the ground is provided. In the following, ground working refers to all work steps with which the ground can be removed or milled, and/or removed or milled ground can be mixed. The ground to be worked can be, for example, an existing traffic surface (street) from which material is to be milled, fills, backfills, or natural ground.

To drive the wheels or crawler tracks, the known stabilizers or recyclers have a drive device which generally comprises a plurality of hydraulic motors which are associated with the individual wheels or running gears. In order to control the drive device, a controller is provided which provides a first driving mode in which the running gears are driven in such a way that the construction machine drives in a first direction of travel at a predetermined speed, and provides a second driving mode in which the wheels or crawler tracks are driven in such a way that the construction machine travels at a predetermined speed in a second direction of travel which is opposite to the first direction of travel. The first direction of travel is a main direction of travel which is generally forward travel. The first driving mode can therefore correspond to forward travel, and the second traveling mode reverse travel. The vehicle driver can set a desired speed for forward or reverse travel.

For manual control by the vehicle driver, self-propelled construction machines have an operating unit with different operating elements. The vehicle driver can start or stop the construction machine by actuating the operating elements and specify the desired speed for forward or reverse travel. These settings can be performed by the vehicle driver during a transport mode in which the construction machine is to be moved from one location to another location, or during a working mode in which the construction machine works the ground.

During the transport and working mode of the construction machine, the problem arises in practice of reversing the direction of travel, i.e. from forward travel to reverse travel, or from reverse travel to forward travel. Reversing the direction of travel places relatively high demands on the vehicle driver since the construction machine must first be brought to a standstill from the given speed to then be accelerated back to a given speed in the opposite direction of travel. It must be considered that the vehicle driver not only has to control the drive device when reversing the direction of travel, but is also responsible for the proper functioning of all other components of the construction machine.

BRIEF SUMMARY

An object in accordance with the present disclosure may be to provide a self-propelled construction machine which can be easily and safely operated in different driving situations by the vehicle driver.

Various embodiments as described herein can comprise one or more of the features or combinations of features mentioned below. A feature designated with an indefinite article can also be present more than once if the indefinite article is not to be understood with an explicit reference to a single use. A designation of features with a number word, for example "first and second", does not exclude that the number of these features can be greater than the number indicated by the number word. In the description of all the embodiments, the expression "can" is also to be understood as "preferably" or "expediently".

An exemplary self-propelled construction machine as disclosed herein may have a controller for automatic reversal of the direction of travel which interacts with the drive device for the wheels or crawler tracks. A drive device is understood below to mean a device with which the wheels or crawler tracks are set in movement. The drive device can be any drive device, for example a hydraulic, mechanical, pneumatic, or electrical drive device which can comprise a plurality of drive components, for example hydraulic motors, wherein a hydraulic motor can be associated with each wheel or crawler track.

The controller may be configured in such a way that the drive device, after receiving a control signal for reversing the direction of travel, reduces the predetermined first speed at which the construction machine travels in the first direction of travel until the construction machine is stationary, and, after the construction machine is stationary, drives the wheels or crawler tracks in the opposite direction, wherein the drive device increases the speed in the second direction of travel up to a predetermined second speed.

The reduction or increase of the speed can take place according to a predefined speed profile, wherein the same or different speed profiles can be specified for the two directions of travel, for example different speed profiles for forward travel in the transport or working mode or reverse travel in the transport or working mode. The speed profiles can be dependent on different operating parameters, for example on the previously specified advance speed, the engine load, the milling roller rotational speed, the load on the lifting columns of the construction machine, etc.

The reversal of the direction of travel can be initiated by a control signal for reversing the direction of travel, wherein the reversal of direction takes place automatically after receipt of the control signal. The control signal can be generated by the machine operator actuating an operating element so that the machine operator can determine the time at which the machine is to reverse the direction of travel. However, a reversal of the direction of travel can also be initiated by automatically generating a control signal for reversing the direction of travel, for example when the construction machine is located at a specific location, for example has reached the end of the lane. The location can be detected with known technical means, for example with a global navigation satellite system (GNSS) or on the basis of detecting a predetermined marking. The control signal can also be generated after covering a predefined distance, or after the expiration of a predefined time interval.

The first speed at which the construction machine moves in the first direction of travel is preferably greater than the second speed at which the construction machine moves in the second direction of travel. It is assumed that the construction machine should move faster in forward travel than in reverse travel.

The first and/or second speed before and/or after the reversal of the direction of travel can be speeds specified by the vehicle driver. The vehicle driver only needs to set one of the two speeds, in particular only the first speed, wherein the second speed, which is preferably slower than the first speed, can then be determined automatically.

An embodiment of a construction machine as disclosed herein has an input and/or operating unit and a memory unit, wherein the input and/or operating unit and the memory unit are configured such that a value for the first and second speed can be input using the input unit and can be stored in the memory unit. The controller is configured such that the controller reads out the value for the first and second speed from the memory unit. Using the input unit, the vehicle driver can therefore enter the speeds and also change them at any time. The input and/or operating unit can have, for example, a joystick, a pedal, or an operating element of a touchscreen.

A further embodiment of the construction machine as disclosed herein provides that the construction machine has an input and/or operating unit and a memory unit which are configured such that a value for the first speed can be input using the input and/or operating unit and can be stored in the memory unit. The controller is configured such that a value for the second speed, which is stored in the memory unit, is calculated from the value for the first speed according to a predefined functional relationship which is stored in the memory unit. This functional relationship can be, for example, a linear equation.

Another exemplary aspect is that not only the drive device, but also other components of the construction machine, are automatically controlled depending on different driving situations.

An embodiment of a construction machine as disclosed herein has a milling/mixing roller adjusting device for adjusting the height of the milling/mixing roller relative to the ground, wherein the controller interacts with the milling/mixing roller adjusting device in such a way that the height of the milling/mixing roller relative to the ground is adjusted during a reversal of the direction of travel. In this embodiment, the machine operator is also relieved of the control of adjusting the height of the milling/mixing roller during a reversal of the direction of travel.

A further embodiment of a construction machine as disclosed herein has a front roller flap facing in the main direction of travel and a rear roller flap facing in the opposite direction to the main direction of travel, which can at least partially close the milling/mixing chamber of the roller housing, and a roller flap adjusting device for adjusting the position of the front roller flap and the rear roller flap. Below, the front roller flap is understood to mean the roller flap facing in the main direction of travel, and the rear roller flap is understood to mean the roller flap facing in the opposite direction to the main direction of travel, wherein the main direction of travel is generally forward travel. The controller interacts with the roller flap adjusting device in such a way that, during a reversal of the direction of travel, the front roller flap and/or the rear roller flap is/are adjusted. In this embodiment, the machine driver operator is also relieved of the control of the roller flaps during a reversal of the direction of travel.

The controller can provide a transport mode in which the controller controls the milling/mixing roller adjusting device in such a way that the milling/mixing roller is raised into an upper position in which the milling/mixing roller does not engage with the ground, and the controller can provide a working mode in which the controller controls the milling/mixing roller adjusting device in such a way that the milling/mixing roller is lowered into a bottom position in which the milling/mixing roller engages with the ground. Engagement with the ground is understood below to mean that the milling/mixing roller mills the ground and/or mixes the milled ground.

A further embodiment of a construction machine as disclosed herein provides that the controller is configured such that, during a reversal of the direction of travel, the controller controls the milling/mixing roller adjusting device in such a way that there is an automatic change from the working mode to the transport mode, or an automatic change from the transport mode to the working mode. In this embodiment, for a reversal of the direction of travel, the machine operator only needs to specify whether the machine is to execute a turning maneuver in order to change from a working mode to a transport mode, or vice versa.

Depending on different driving situations, a construction machine as disclosed herein can provide the following control modes which can be initiated by a travel direction reversal control signal. The different control modes allow the machine operator to easily and safely control the construction machine in the different driving situations.

For a first travel direction reversal control mode with a reversal of the direction of travel in the transport mode, the controller can be configured in such a way that the controller controls the milling/mixing roller adjusting device such that the position of the milling/mixing roller is maintained during the reversal of the direction of travel, and controls the roller flap adjusting device such that the position of the roller flaps is maintained during the reversal of the direction of travel. The machine operator can specify this control mode if the machine is to be moved only from one location to another location.

For a second travel direction reversal control mode with a reversal of the direction of travel in the working mode, the controller can be configured such that the controller controls the milling/mixing roller adjusting device in such a way that the position of the milling/mixing roller is maintained during the reversal of the direction of travel, and the controller controls the roller flap adjusting device for the front and rear roller flap before the direction is reversed such that the front roller flap is in a raised position, and the rear roller flap rests in a floating position on the ground, and, after the direction has been reversed, the originally rear roller flap now facing in the new direction of travel is in a raised position, and the front roller flap rests in a floating position on the ground. The machine operator can specify this control mode if the construction machine is to travel in reverse in the same lane in order to mix the milled material after reversing the direction of travel.

For a third travel direction reversal control mode for reversing the travel direction with a change from the transport mode to the working mode, the controller can be configured in such a way that the controller controls the milling/mixing roller adjusting device such that the milling/ mixing roller is lowered from the upper position in which the milling/mixing roller does not engage with the ground into the bottom position in which the milling/mixing roller engages with the ground. Following a journey, the machine operator can specify this control mode if the construction machine is to move in the opposite direction of travel, for example, at the beginning or the end of the lane in order to work the ground.

In order to control the milling/mixing roller, the controller can be configured in the third travel direction reversal control mode in such a way that the controller controls the milling/mixing roller adjusting device in such a way that the milling/mixing roller is lowered at a predetermined speed, wherein the speed at which the milling/mixing roller is lowered is a speed that remains constant over the distance covered by the construction machine, or a speed that changes over the distance covered by the construction machine. The change in milling depth can be initiated at a time before and/or during the reduction of the speed of the construction machine, and/or when the construction machine is at a standstill, and/or during the increase in the speed. The change in the milling depth while lowering the milling/mixing roller can be adapted to the different circumstances and can be dependent on different operating parameters, for example the advance of the construction machine, the nature of the ground to be worked, or the amount of binder added.

In order to control the roller flaps, the controller can be configured in the third travel direction reversal control mode in such a way that the controller controls the roller flap adjusting device for the front and rear roller flaps such that the front roller flap is in a raised position after lowering the milling/mixing roller in the working mode, and the rear roller flap rests in a floating position on the ground or the rear roller flap is in a raised position, and the front roller flap rests in a floating position on the ground. Consequently, the roller flaps are automatically brought into the position intended for the working mode, depending on the direction of travel.

The controller can provide a fourth travel direction reversal control mode for a reversal of the direction of travel with a change from the working mode to the transport mode, in which the controller controls the milling/mixing roller adjusting device in such a way that the milling/mixing roller is raised from the bottom position, in which the milling/mixing roller engages with the ground, into the upper position in which the milling/mixing roller does not engaged with the ground. The machine operator can specify this control mode if the construction machine is to be reversed after working the ground, for example at the end of the lane.

In the fourth travel direction reversal control mode, the controller can be configured such that the controller controls the milling/mixing roller adjusting device in such a way that the milling/mixing roller is raised at a predetermined speed, wherein the speed at which the milling/mixing roller is raised is a speed that remains constant over the distance covered by the construction machine, or a speed that changes over the distance covered by the construction machine. The change in milling depth can be initiated at a time before and/or during the reduction of the speed of the construction machine, and/or when the construction machine is at a standstill, and/or during the increase in the speed. The change in the milling depth during raising of the milling/mixing roller can be adapted to the different circumstances and can be dependent on different operating parameters, for example the advance of the construction machine, the nature of the ground to be worked, or the amount of binder added.

The lowering and raising of the milling/mixing roller for a change from the transport mode to the working mode, or from the working mode to the transport mode can take place according to a speed profile specified by the controller. The speed profile can be a fixedly predefined profile which is stored in a memory device, or the speed profile can be determined depending on the current operating parameters of the construction machine.

When changing from the transport mode to the working mode, a device for adding binder can also be automatically activated so that binder is added in the working mode. Conversely, when changing from the working mode to the transport mode, a device for adding binder can be automatically deactivated so that no binder is added in the transport mode.

During a reversal of the direction of travel, all settings of operating parameters of the self-propelled construction machine can in principle be made, or specified settings can be changed, or certain operating states can be set or changed in order to adapt the operating parameters or operating states to the new direction of travel. These settings can in turn be made depending on whether the construction machine is in a specific mode, in particular in a transport mode or working mode.

For example, self-propelled construction machines generally provide certain steering modes, wherein steering is done only with the front wheels or crawler tracks, only with the rear wheels or crawler tracks, with the front and rear wheels or crawler tracks in the same direction, or with the front and rear wheels or crawler tracks in opposite directions. During a reversal of direction from forward travel to reverse travel, for example, it is possible to switch from a steering mode in which steering takes place only with the front wheels or crawler tracks to a steering mode in which steering takes place with the front and rear wheels or crawler tracks in the same direction. This changing of the steering mode during the reversal of the direction of travel from forward travel to reverse travel at the end of a lane allows the construction machine to be moved sideways relative to the lane in reverse travel so that the construction machine can be driven out of the lane.

In the event of a reversal of the direction of travel, assistance systems of the construction machine can also be activated or deactivated, or their settings can be changed. If the construction machine has, for example, an assistance system based in particular on satellite navigation which, after reversing the direction, allows the construction machine to travel back in the same lane, this assistance system can be activated after the direction has been reversed so that the construction machine travels back in the same lane.

If the construction machine has a camera system for monitoring obstacles in the surroundings, a backup camera can be activated, for example, during a reversal of the direction of travel from forward travel to reverse travel. A front camera can then be deactivated.

BRIEF DESCRIPTION OF THE SEVERAL VIEWS OF THE DRAWINGS

Various embodiments will be explained in more detail below with reference to the drawings.

DETAILED DESCRIPTION

Figure 1:
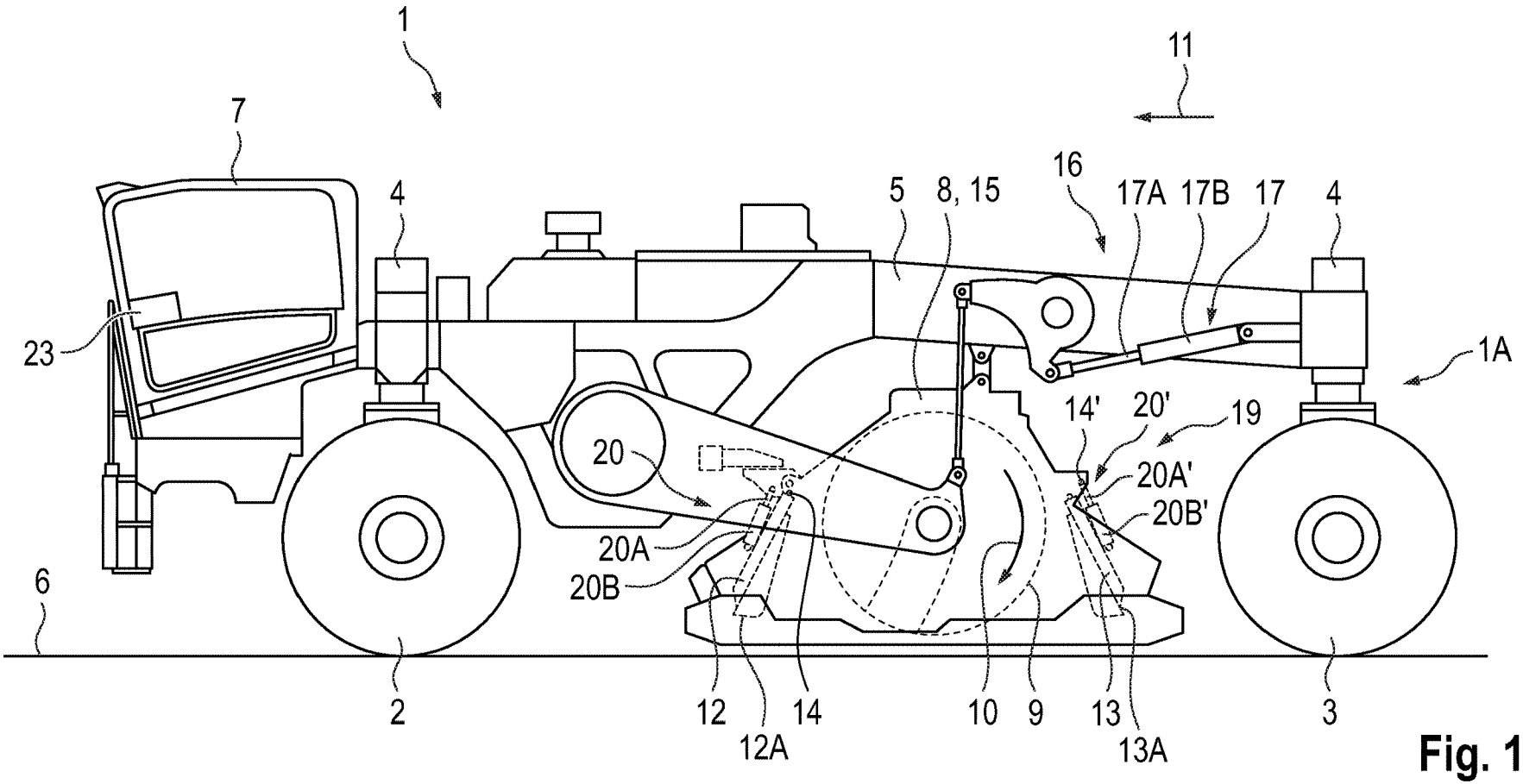
FIG. 1 shows an embodiment of a self-propelled construction machine as disclosed herein, in a partially sectional view.

FIG. 1 shows a side view of a self-propelled construction machine 1 which is described in detail in EP 2 977 514 B1. The construction machine 1 has a chassis 1A which comprises two front wheels 2 and two rear wheels 3 in the main direction of travel (forward travel). Lifting columns 4, which carry a machine frame 5, are fastened to each of the wheels 2, 3 so that the height of the machine frame can be adjusted relative to the ground 6. The driver's cab 7, in which an operating unit 23 is provided which can have a touchscreen, is located on the machine frame 5. The wheels are driven by a drive apparatus (not shown in FIG. 1) which comprises hydraulic motors (not shown in FIG. 1) that are associated with the wheels.

A roller housing 8 that is open at the bottom and forms a milling/mixing chamber and in which a milling/mixing roller 9 is located is arranged between the running gears on the machine frame 5. The direction of rotation of the milling/mixing roller is indicated by an arrow 10. The roller housing 8 has a roller flap 12 that is at the front in the main working direction 11 (forward travel) and a roller flap 13 that is at the rear in the main working direction, which are each pivotable about a pivot axis 14 or 14' running transversely to the longitudinal direction of the machine frame. The roller housing is closed on the sides by side parts 15 that extend in the longitudinal direction, and are only shown in outline in FIG. 1.

To adjust the height of the milling/mixing roller 9, the ground milling machine has a milling/mixing roller adjusting device 16 which, in the present embodiment, comprises a piston-cylinder assembly 17 with a piston 17A and a cylinder 17B. By actuating the piston 17A of the piston-cylinder assemblies 17, the height of the milling/mixing roller 9 can be adjusted relative to the machine frame 5 or the ground 6, wherein the axis of the milling/mixing roller moves on a circular path. Alternatively or additionally, it is also possible to adjust the height of the milling/mixing roller 9 relative to the ground 6 by retracting or extending the lifting columns 4.

To adjust the position of the front and rear roller flaps 12, 13 in the main working direction, a roller flap adjusting device 19 is provided which has an actuator 20, 20' acting on the corresponding roller flap 12, 13. In the present embodiment, the actuators are piston-cylinder assemblies 20, 20', the pistons 20A, 20A' of which are pivotally fastened to the machine frame 5 and their cylinders 20B, 20B' on the front or rear roller flap 12, 13. By moving the relevant piston, the front or rear roller flap 12, 13 can be pivoted upward or downward so that the lower edge 12A, 13A of the front or rear roller flap 12, 13 lifts or lowers relative to the ground 6.

The drive device for driving the wheels, the milling/mixing roller adjusting device and the roller flap adjusting device comprise further components, in particular hydraulic components, for example hydraulic pumps, hydraulic valves, hydraulic lines, sensors, etc., which are not shown for the sake of simplicity but are generally known to a person skilled in the art.

A controller is provided for controlling the individual components of the drive device for driving the wheels, the milling/mixing roller adjusting device, and the roller flap adjusting device. This controller can comprise a plurality of control units, one control unit or a plurality of control units of which can be part of a central controller of the construction machine. The drive device for driving the wheels, the milling/mixing roller adjusting device, and the roller flap adjusting device can, for example, each have their own control unit which is understood below as a common controller.

The controller can have, for example, a general processor, a digital signal processor (DSP) for continuously processing digital signals, a microprocessor, an application-specific integrated circuit (ASIC), an integrated circuit consisting of logic elements (FPGA), or other integrated circuits (IC) or hardware components in order to carry out the control of the actuators. A data processing program (software) can run on the hardware components.

Figure 2:
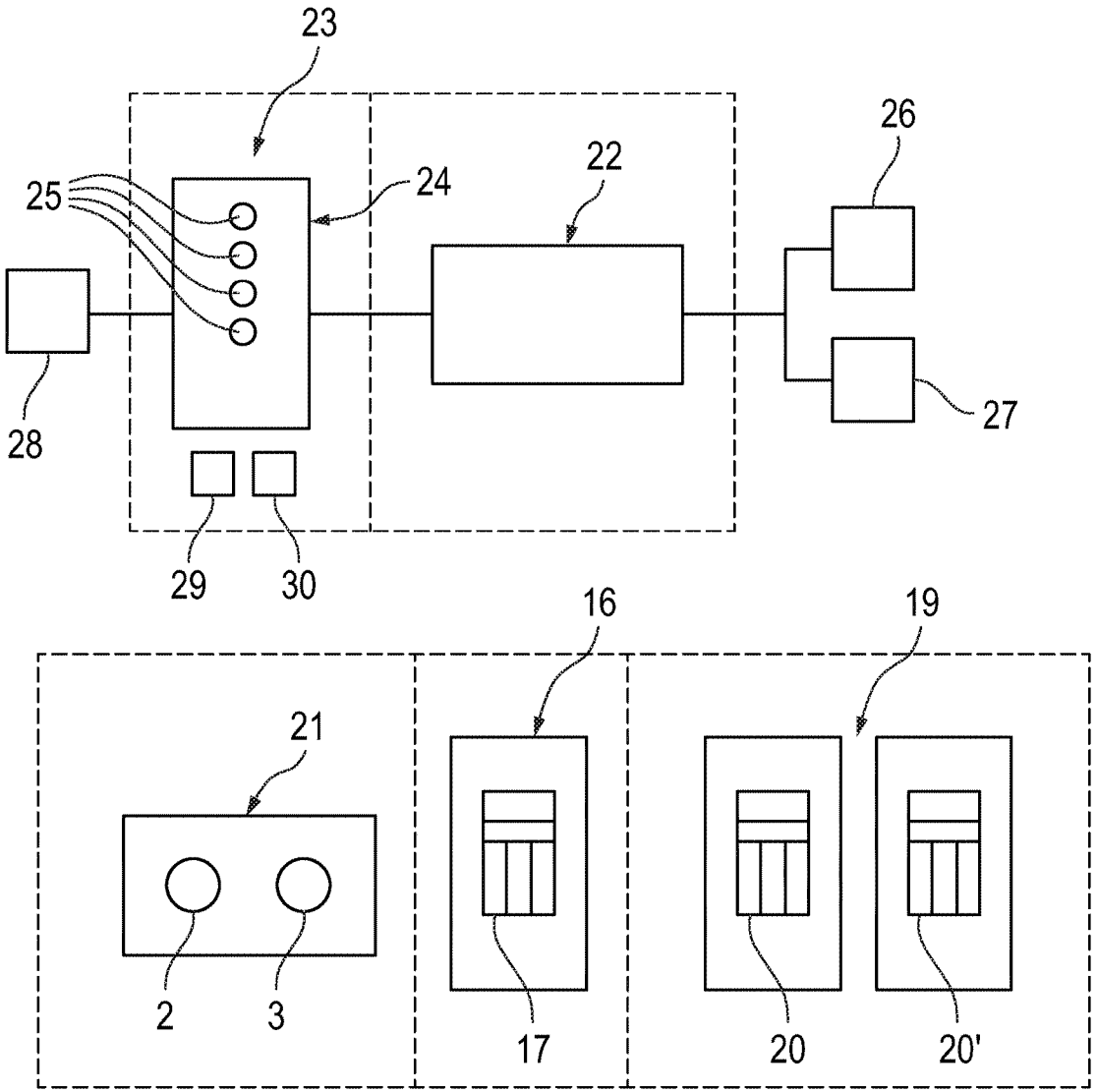
FIG. 2 shows a diagram for illustrating the function of the individual components of the construction machine in FIG. 1.

FIG. 2 shows a diagram illustrating the function of the individual components of the construction machine. FIG. 2 shows, in a highly simplified manner, a drive device 21 for driving the wheels, the milling/mixing roller adjusting device 16 with the piston-cylinder assembly 17 for adjusting the height of the milling/mixing roller 9, the roller flap adjusting device 19 for actuating the roller flaps 12, 13 via the piston-cylinder assemblies 20, 20' and a controller 22. FIG. 2 also shows the operating unit 23 provided in the driver's cab, which has a touchscreen 24 on which a plurality of buttons 25, 29, 30 are shown which can be actuated by the machine operator to select different control modes.

Figure 3:
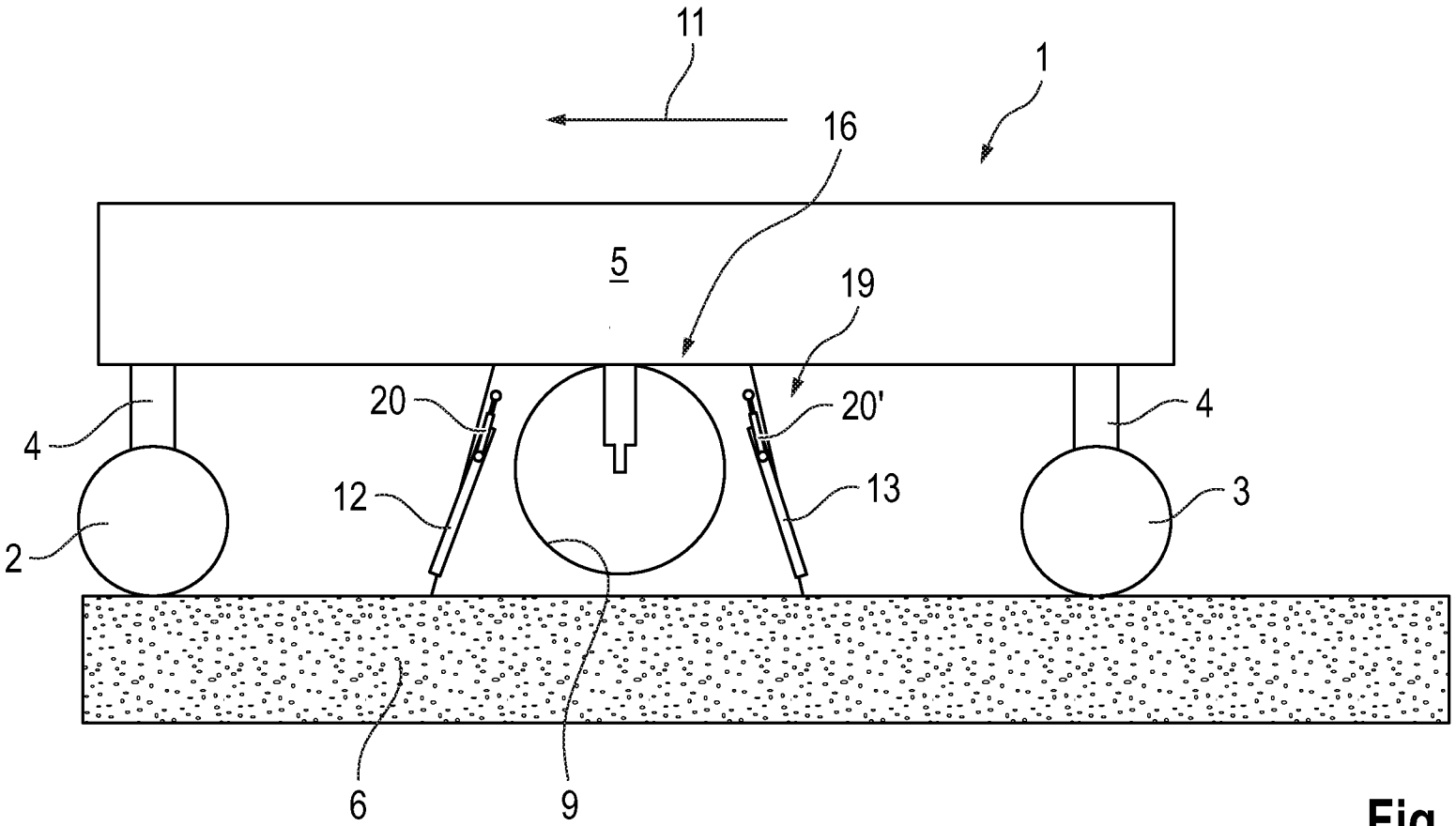
FIG. 3 is a greatly simplified view of the construction machine in the transport mode in during forward travel.
Figure 4:
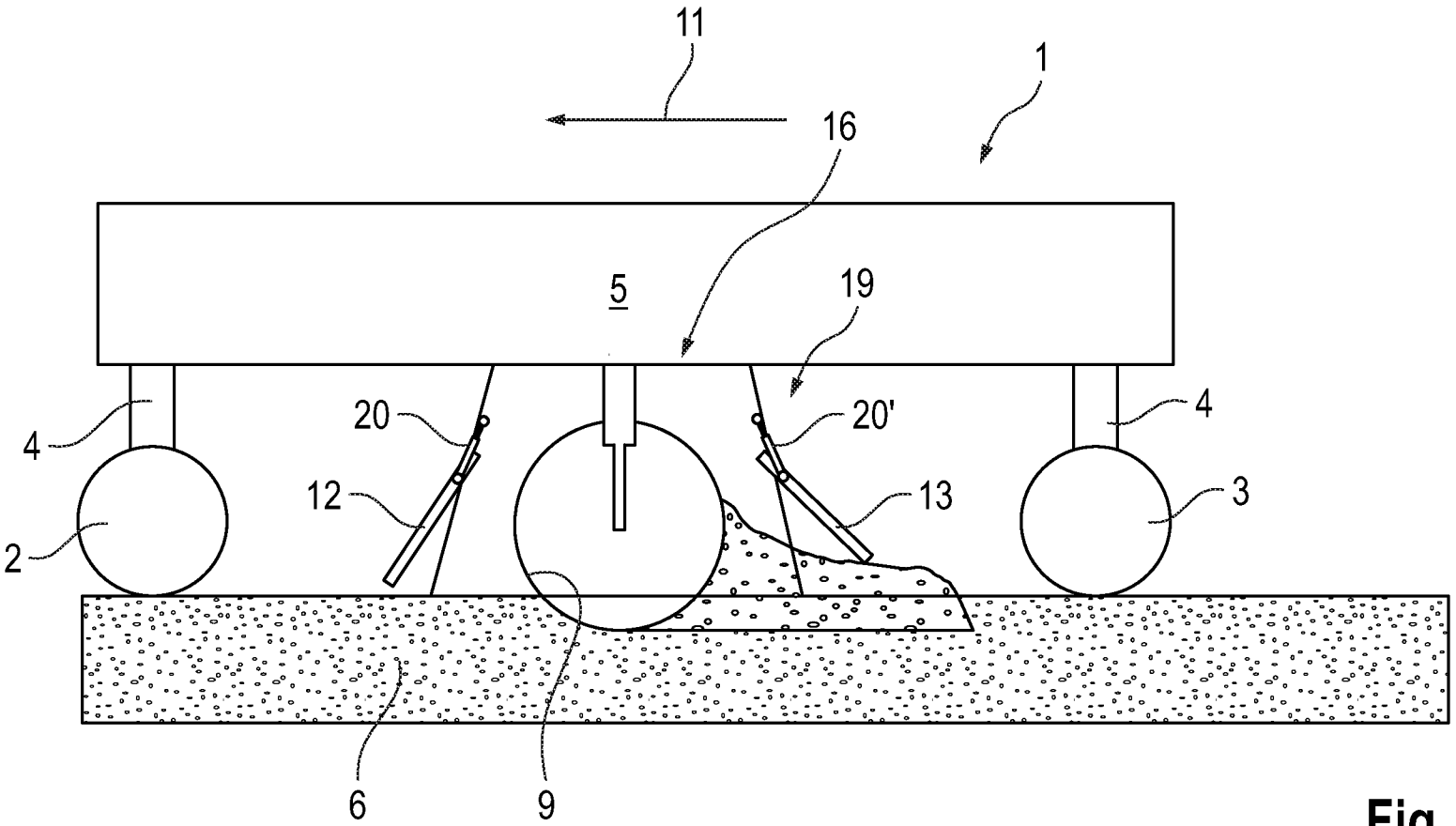
FIG. 4 is a greatly simplified view of the construction machine in the working mode during forward travel.

A construction machine as disclosed herein, which can be operated in a transport mode or in a working mode, allows for automatic reversal of the direction of travel. FIG. 3 shows a highly simplified view of the construction machine 1 in the transport mode in which the milling/mixing roller 9 is raised and does not engage with the ground 6, and FIG. 4 shows a highly simplified view of the construction machine 1 in the working mode in which the milling/mixing roller 9 is lowered and engages with the ground 6. The individual components are denoted by the same reference signs as in FIGS. 1 and 2.

The controller 22 is configured such that different control modes can be specified depending on control signals.

The controller 22 is configured such that the piston-cylinder assembly 17 of the milling/mixing roller adjusting device 16 is actuated after receiving a control signal in such a way that, after receiving the control signal, the milling/mixing roller 9 is lowered from the upper position into the bottom position for a change from the transport mode shown in FIG. 3 to the working mode shown in FIG. 4 and, after receiving a control signal, the milling/mixing roller 9 is raised from the bottom position (FIG. 4) into the upper position (FIG. 3) for a change from the transport mode to the working mode.

The controller is further configured such that the front or rear piston-cylinder assembly 20, 20' of the roller flap adjusting device 19 is actuated after receiving a control signal in such a way that the roller flaps 12, 13 in the transport position are in a folded-down position in which the roller flaps at least partially close the roller housing 8 at the front and rear sides.

Furthermore, the controller 22 is configured such that, after receiving a control signal, the rear roller flap 13 in the working mode is in a floating position in which the rear roller flap rests on the milled ground with a specified contact force so that the roller housing 8 is at least partially closed on the rear side. Devices for positioning a roller flap in a floating position belong to the prior art (DE 10 2004 012 382 B4). In the working mode, the front roller flap 12 is adjusted by the controller 22 such that the front roller flap is in a specified, preferably slightly raised position so that it cannot become jammed when the construction machine is advanced (FIG. 4).

The controller 22 of a construction machine as disclosed herein may allow for the specification of a plurality of travel direction reversal control modes depending on the reception of a travel direction reversal control signal associated with the corresponding travel direction reversal control mode. In the present embodiment, the operating unit 23 is configured such that a travel direction reversal control signal is generated when the vehicle driver selects a travel direction reversal control mode by actuating a pushbutton or one of the buttons 25 of the touchscreen 24 so that a travel direction reversal control signal is generated. However, a travel direction reversal control signal can also be generated by other units, for example a satellite navigation system 26 (GNSS) which is configured such that the control signal is generated at a specific waypoint in a coordinate system. However, the unit can also be configured in such a way that the control signal is generated when a predetermined marking is detected on the path covered by the construction machine. There can also be a control signal after a predefined distance has been covered or after the expiration of a predetermined time interval. In FIG. 2, such units 26, 27 for generating travel direction reversal control signals which interact with the controller are only in outline.

The individual travel direction reversal control modes, which can be selected by the machine operator by actuating the relevant buttons 25 of the touchscreen 24 and/or after receiving a corresponding control signal from one of the units 26, 27 mentioned by way of example, are described in detail below.

FIGS. 5A to 5D illustrate a travel direction reversal control mode for automated travel direction reversal in the transport mode shown in FIG. 3. The controller 22 controls the milling/mixing roller adjusting device 16 in such a way that the position of the milling/mixing roller 9 is maintained during the reversal of the direction of travel and controls the roller flap adjusting device 19 in such a way that the position of the roller flaps 12, 13 is maintained during the reversal of the direction of travel.

The construction machine 1 initially travels at a speed $V_1$ which can be specified by the vehicle driver before the direction of travel is reversed. In the following, index 1 indicates the speed of the construction machine before a reversal of the travel direction, and index 2 indicates the speed after a reversal of the travel direction. The vehicle driver can specify the speed $V_1$, for example by actuating an operating element 29 on the operating unit 23, wherein the speed $V_1$ is stored in a memory 28 which is read by the controller 22 (FIG. 2). The vehicle driver can make the speed $V_1$ dependent on whether the construction machine is in the transport mode or working mode. In general, the speed $V_1$ should be slower in the working mode than in the transport mode.

Figure 5A:
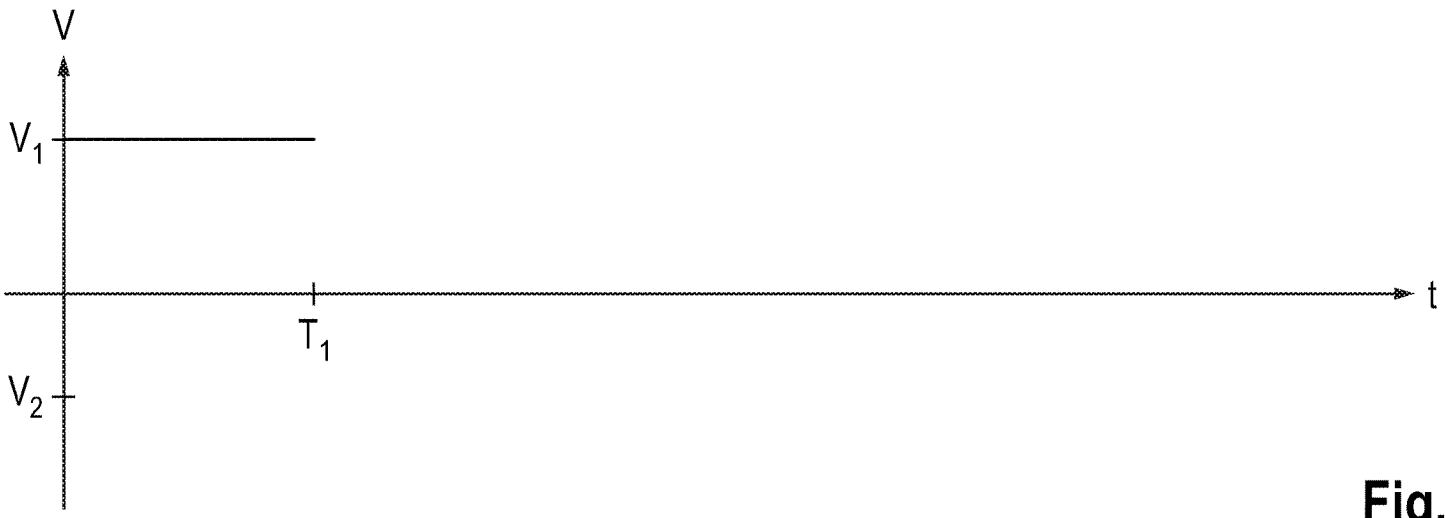
FIGS. 5A to 5D show the movement of the construction machine during automatic reversal of the direction of travel.
Figure 5B:
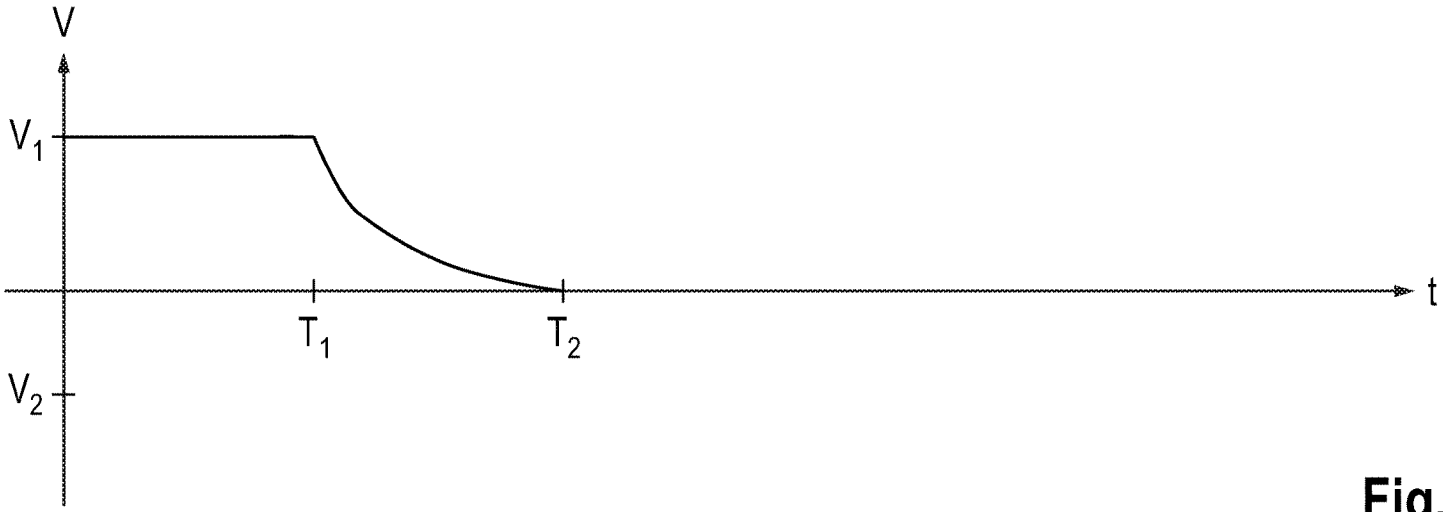
Figure 5C:
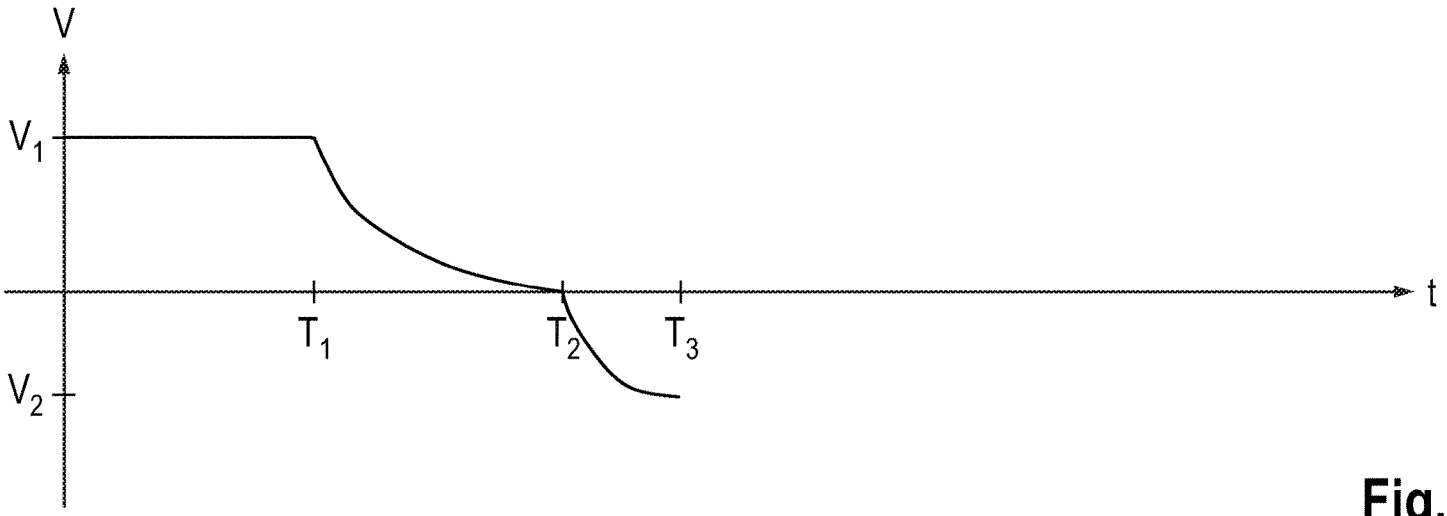
Figure 5D:
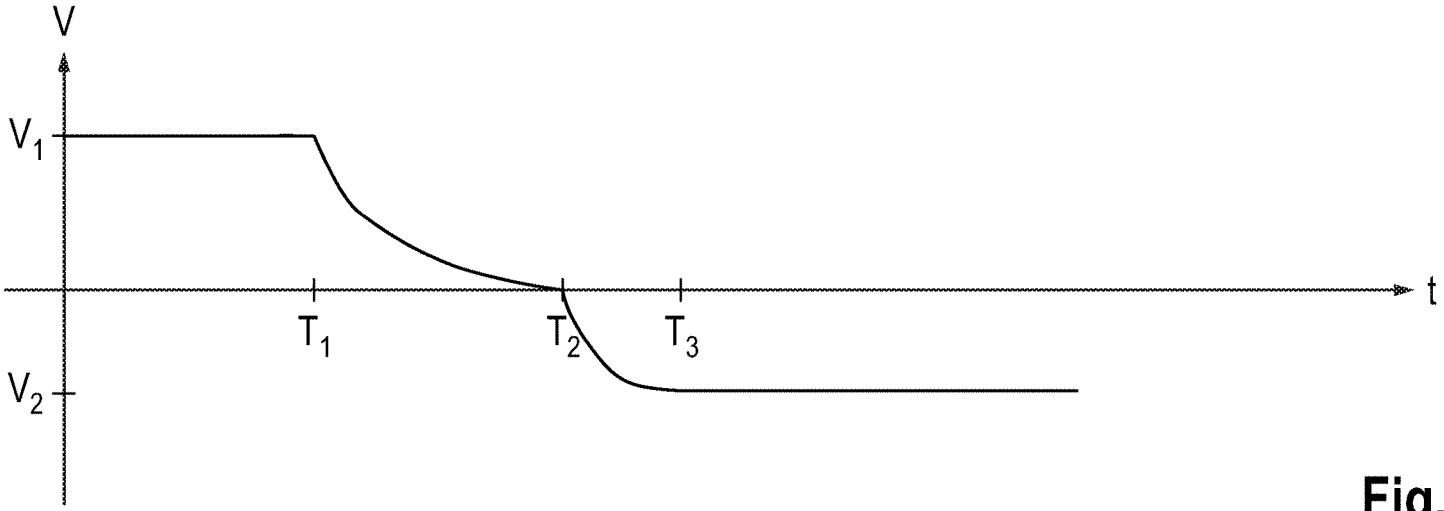

If the vehicle driver actuates the button 25 for selecting the relevant travel direction reversal control mode, the relevant travel direction reversal control signal is generated (FIG. 5A). After receipt of the travel direction reversal control signal at time $T_1$, the drive device 21 reduces the predefined first advance speed $V_1$ at which the construction machine travels in the first direction of travel until the construction machine is stationary at time $T_2$ in accordance with a specified speed profile (FIG. 5B). The speed profile is specified by the controller 22. In the present embodiment, the controller 22 specifies a certain, for example non-linear, speed profile for braking from forward travel, which speed profile can be dependent on various machine parameters, for example the previously specified first speed $V_1$, the engine load, the milling roller speed, the load on the lifting columns of the construction machine, etc. After the construction machine has come to a standstill, the drive device 21 drives the wheels 2, 3 in the opposite direction, wherein the drive device increases the speed in the second direction of travel back up to a predetermined second speed $V_2$. In the present embodiment, the construction machine is accelerated immediately after being stationary up to the time $T_3$ so that the construction machine is not stationary for a predetermined time interval $\Delta T$ (FIG. 5C). The construction machine then moves at the second speed $V_2$ (FIG. 5D).

The machine operator can also specify the second speed $V_2$ by actuating an operating element 30 on the operating unit 23, wherein the speed $V_2$ is also stored in the memory 28 which is read by the controller 22 (FIG. 2). The speed $V_2$ can again be dependent on whether the construction machine is in the transport mode or working mode. In general, the speed $V_2$ should be slower in the working mode than in the transport mode. In the drawings, the speed curves are shown only by way of example.

An alternative embodiment provides that the speed $V_2$ is automatically determined depending on the first speed $V_1$. The controller 22 then calculates the second speed $V_2$, for example, according to the equation:

$$V_2 = V_1 \times k,$$

wherein k is a factor greater than 0 and less than 1.

A further travel direction reversal control mode is described below for an automated reversal of the direction of travel in the working mode shown in FIG. 4, wherein the controller 22 controls the milling/mixing roller adjusting device 16 in such a way that the position of the milling/mixing roller 9 is maintained during the reversal of the direction of travel, but controls the roller flap adjusting device 19 such that the position of the roller flaps 12, 13 is changed during the reversal of the direction of travel.

Figure 6:
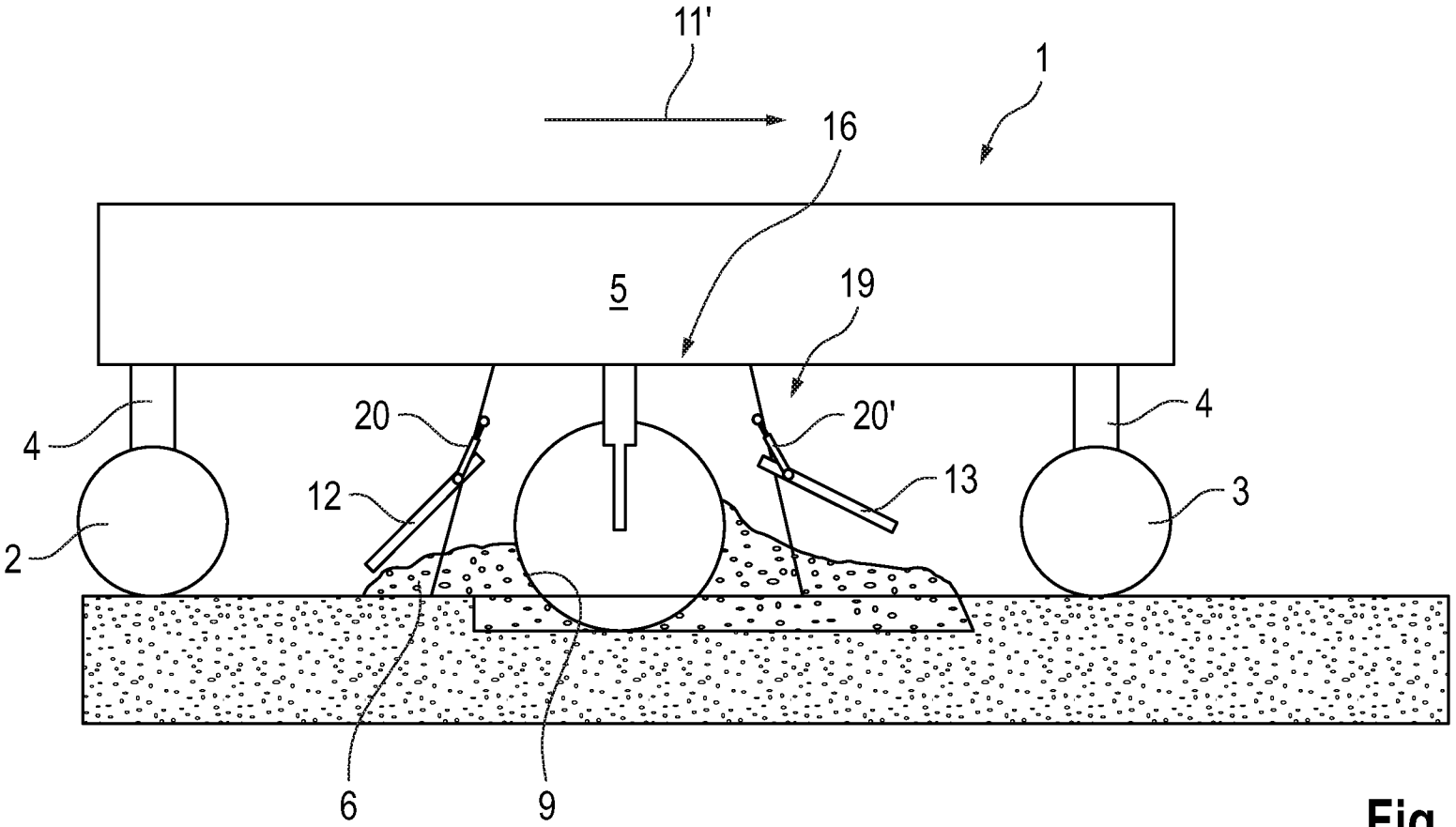
FIG. 6 is a highly simplified view of the construction machine in the working mode during reverse travel.

FIG. 4 shows the position of the front and rear roller flaps 12, 13 during forward travel 11 at the speed $V_1$. Before the reversal of the direction of travel, the controller 22 controls the roller flap adjusting device 19 of the front and rear roller flaps 12, 13 in such a way that the front roller flap 12 is in a predetermined raised position, and the rear roller flap 13 rests on the raised ground in a floating position. FIG. 6 shows the position of the front and rear roller flaps 12, 13 during reverse travel in the opposite direction of travel 11' at the speed $V_2$. After the reversal of the direction of travel, the previously rear roller flap 13 is in a raised position and the previously front roller flap 12 lies in a floating position on the ground. After changing direction, the rear roller flap 13 assumes an equivalent position, for example an open or closed position, to the front roller flap 12 before changing direction.

Further travel direction reversal control modes are described below with reference to FIGS. 7A, 7B to 13A and 13B, which illustrate an automated reversal of the direction of travel with a simultaneous change of the operating mode from a transport mode to a working mode (FIGS. 7A, 7B to 9A, 9B), or a simultaneous change of the operating mode from a working mode into a transport mode (FIGS. 10A, 10B to 13A, 13B).

For the individual travel direction reversal control modes which the machine operator can select or are automatically specified, the controller 22 is configured such that the construction machine 1 moves as follows when the reversal of the direction of travel on the terrain is initiated, and the subsequent settings of the milling/mixing roller 9 and/or the roller flaps 12, 13 are made.

Figure 7A:
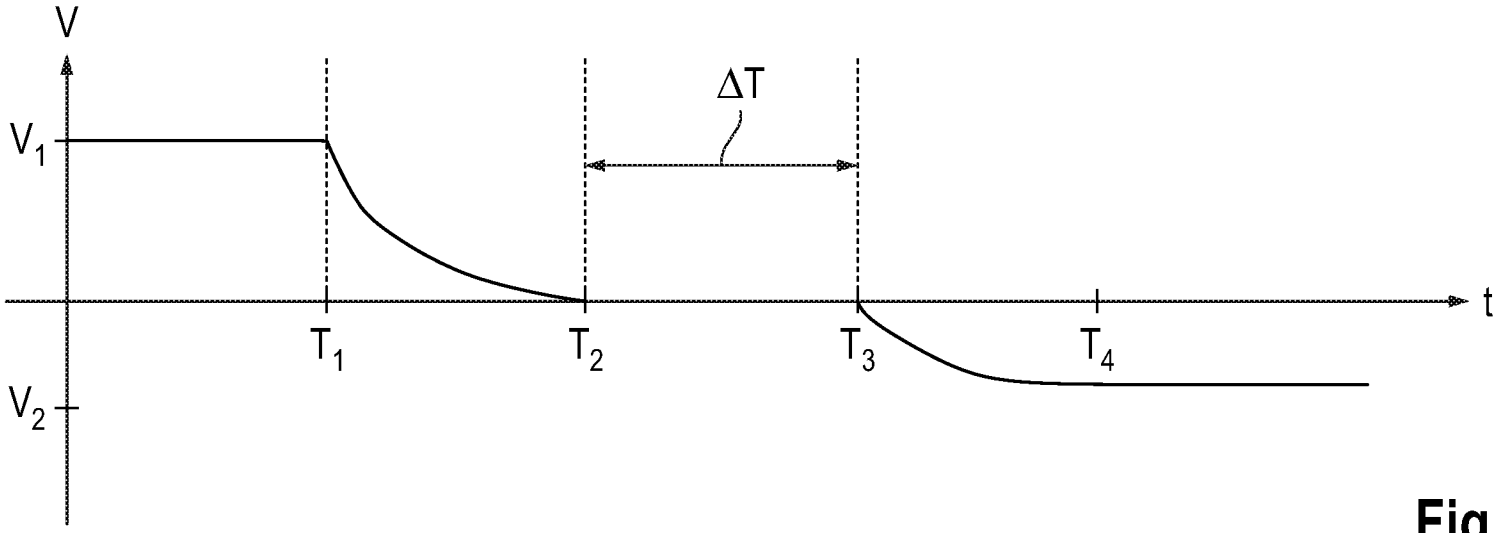
FIGS. 7A and 7B show an embodiment of the movement of the construction machine during a reversal of the direction of travel with a change from a transport mode to a working mode.
Figure 7B:
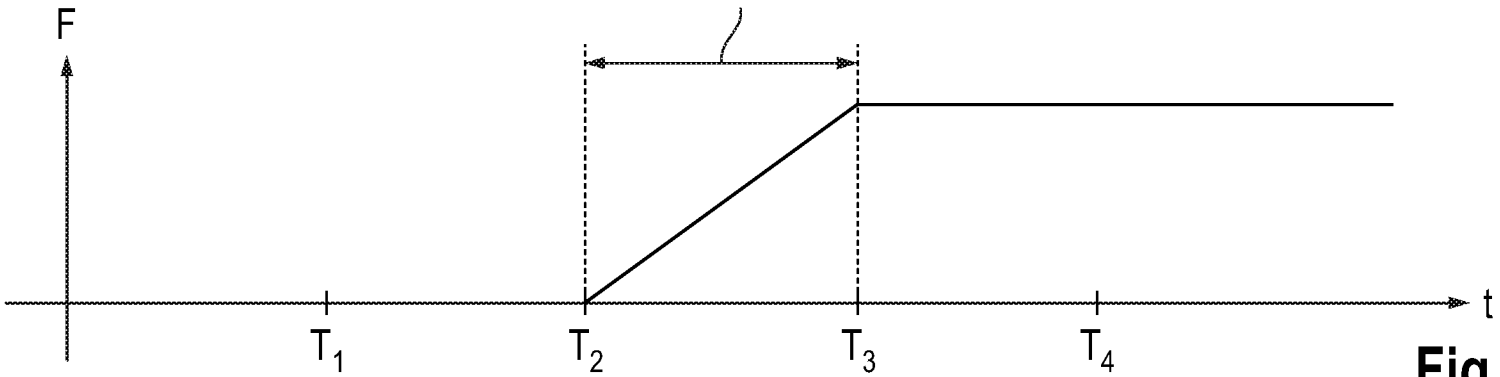

FIGS. 7A and 7B illustrate a travel direction reversal control mode for a reversal of the direction of travel with a change from the transport mode to the working mode. The construction machine 1 initially moves at the speed $V_1$ specified by the vehicle driver. At time $T_1$, the speed V is reduced according to a specified, non-linear speed profile until the construction machine is stationary at the time $T_2$ (V=0). The construction machine is stationary for the time interval ΔT up to the time $T_3$. The drive device 21 then drives the wheels 2, 3 of the construction machine in the opposite direction of travel, wherein the speed of the construction machine is increased again according to a specified, non-linear speed profile, which differs from the speed profile before the reversal of the direction of travel, until the construction machine has reached the speed $V_2$, which is slower than speed $V_1$, at time $T_4$ (FIG. 7A).

In the present embodiment, the change from the transport mode to working mode takes place in the time interval ΔT. The controller controls the milling/mixing roller adjusting device 19 at the time $T_2$ such that the milling/mixing roller 9 is lowered from the upper position (FIG. 3) into the bottom position (FIG. 7B) according to a specified profile. In the present embodiment, the milling/mixing roller 9 is lowered at a constant speed so that the milling depth F increases continuously. The milling/mixing roller 9 reaches the bottom position at the time $T_3$ at which the construction machine begins to drive back in the opposite direction of travel (FIG. 7A). The change from the transport mode to the working mode is automatically initiated during this travel direction reversal control mode as soon as the construction machine is stationary. Alternatively, however, this change can also take place only when the controller receives a corresponding control signal which is generated when the machine operator actuates an operating element on the operating unit.

The controller can also be configured such that the roller flaps 12, 13 are moved from the position shown in FIG. 3, which at least partially closes the roller housing 8, into a position in which, depending on the direction of travel, the front roller flap 12 is in a raised position, and the rear roller flap 13 rests on the ground in a floating position, or the rear roller flap is in a raised position, and the front roller flap rests on the floor in a floating position (FIG. 4). Furthermore, the controller 22 can also make further interventions in the machine control in order to start milling/mixing. The controller can in particular activate a device provided on the construction machine for adding binder.

Figure 8A:
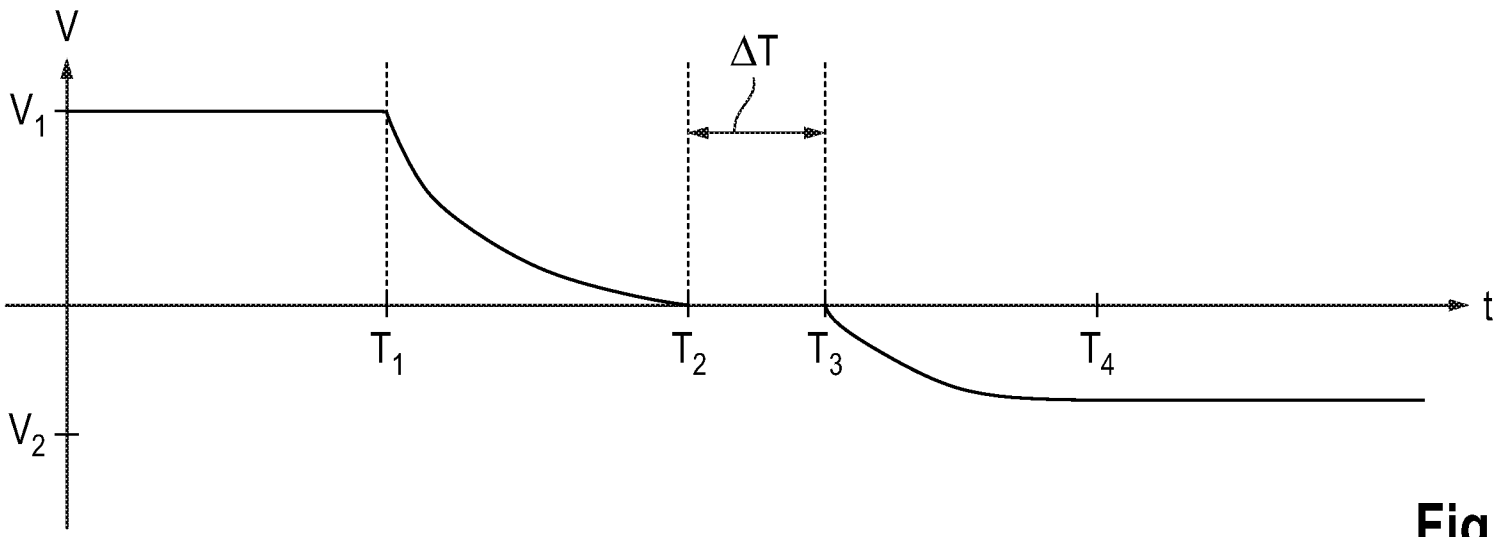
FIGS. 8A and 8B show a further embodiment of the movement of the construction machine during a reversal of the direction of travel with a change from a transport mode to a working mode.
Figure 8B:
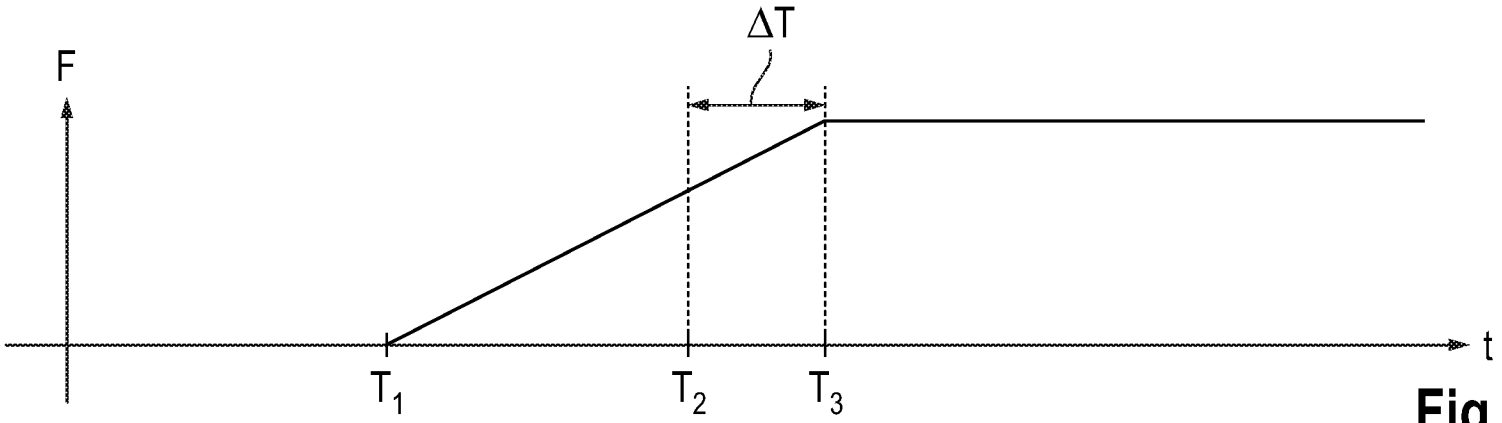

FIGS. 8A and 8B illustrate a further travel direction reversal control mode for a reversal of the direction of travel with a change from the transport mode to the working mode. This travel direction reversal control mode differs from the control mode according to FIGS. 7A and 7B by a shorter time interval ΔT and by the fact that the controller already begins to lower the milling/mixing roller 9 at time $T_1$ when the controller 22 begins to reduce the speed V of the construction machine 1. At time $T_2$, the construction machine comes to a standstill. At time $T_3$, the milling/mixing roller 9 is in the bottom position, and the construction machine starts to move again in the opposite direction of travel. In the present embodiment, the milling/mixing roller 9 is lowered at a constant speed so that the milling depth F increases continuously.

Figure 9A:
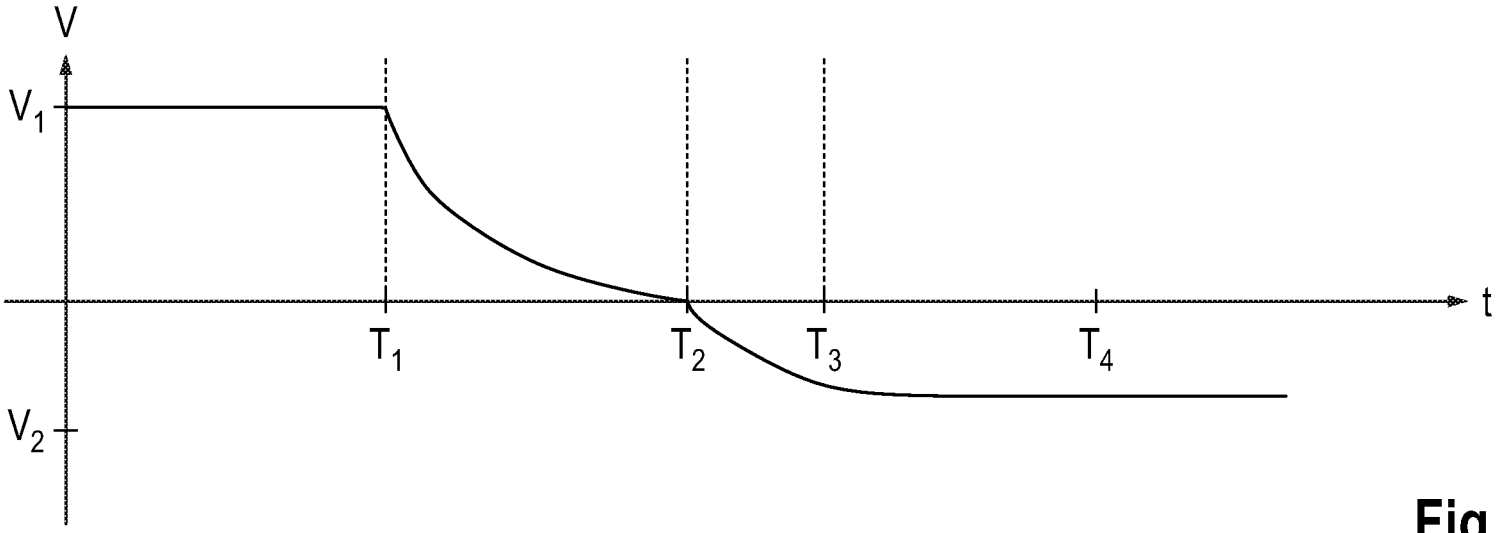
FIGS. 9A and 9B show a further embodiment of the movement of the construction machine during a reversal of the direction of travel with a change from a transport mode to a working mode.
Figure 9B:
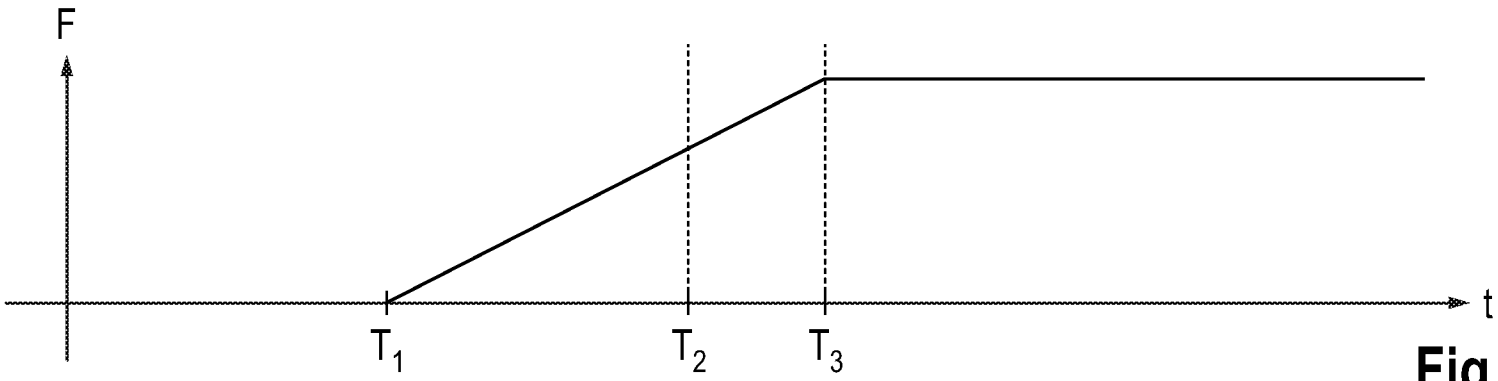

FIGS. 9A and 9B illustrate a further travel direction reversal control mode for a reversal of the direction of travel with a change from the transport mode to the working mode. This travel direction reversal control mode differs from the control mode according to FIGS. 8A and 8B in that the construction machine 1 does not stop for a predetermined time interval. The controller 22 accelerates the construction machine 1 at time $T_2$ back in the opposite direction of travel. The milling/mixing roller is lowered during the time interval $\Delta T=T_3-T_1$ while the construction machine is decelerated and accelerated.

Figure 10A:
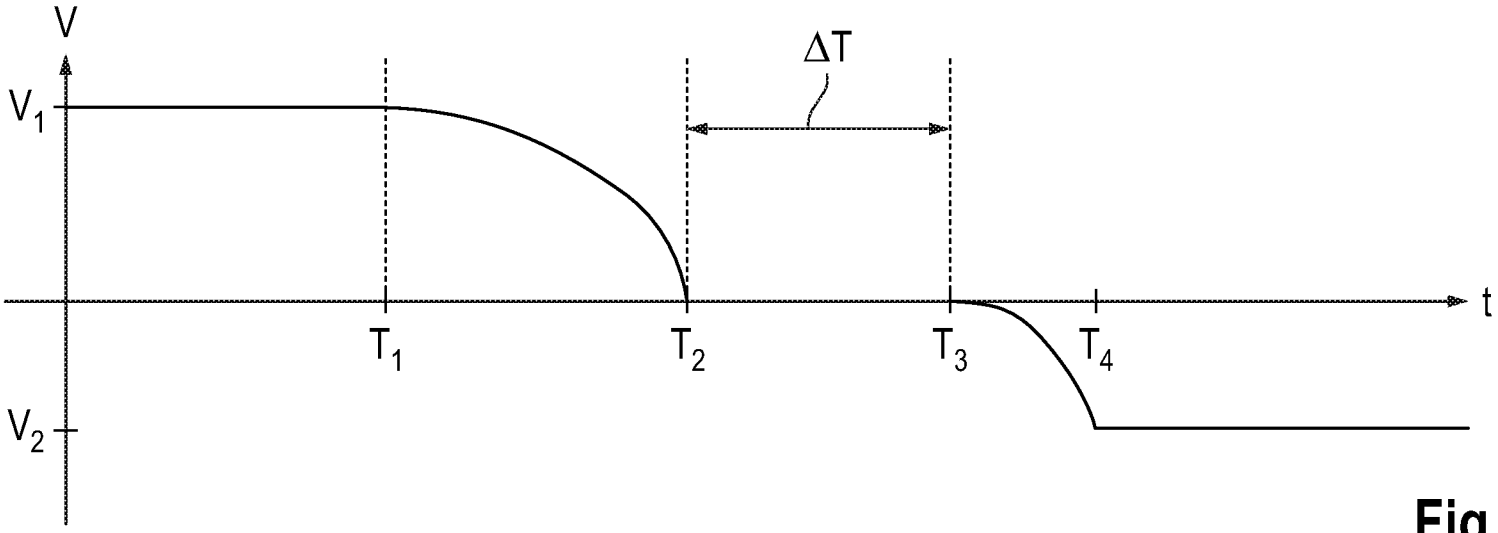
FIGS. 10A and 10B show an embodiment of the movement of the construction machine during a reversal of the direction of travel with a change from a working mode to a transport mode.
Figure 10B:
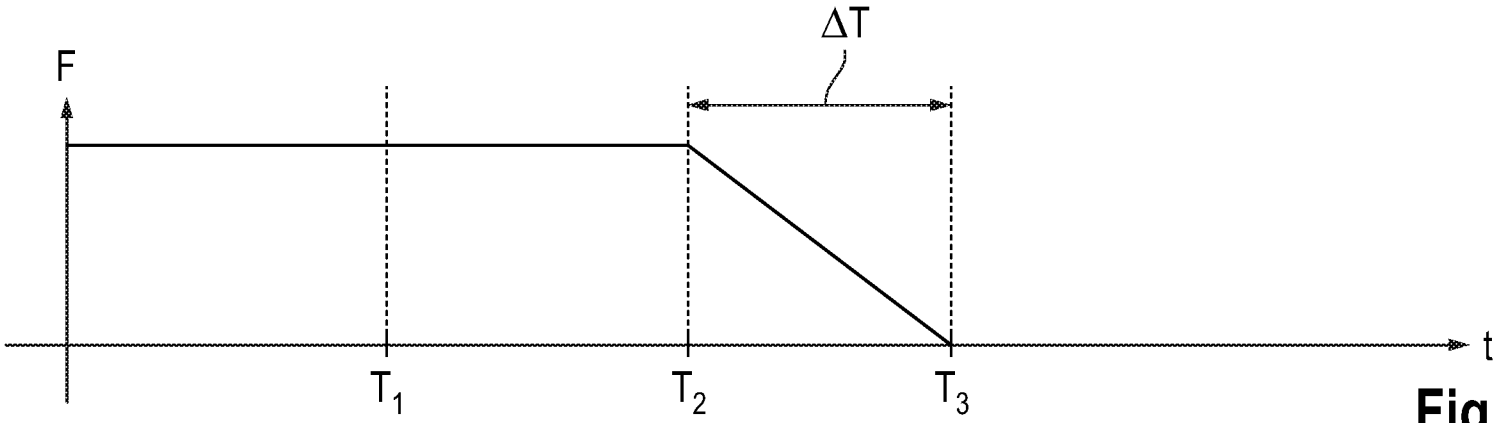

FIGS. 10A and 10B illustrate a travel direction reversal control mode for a reversal of the direction of travel with a change from the working mode to the transport mode. The construction machine 1 initially moves at the speed $V_1$ specified by the vehicle driver. At time $T_1$, the speed V is reduced after a predetermined, non-linear speed profile, which differs from the speed profile from FIGS. 7A, 8A and 9A, until the construction machine comes to a standstill at time $T_2$ (V=0). The construction machine is stationary for the time interval ΔT up to the time $T_3$. The drive device 21 then drives the wheels 2, 3 of the construction machine in the opposite direction of travel, wherein the speed V of the construction machine is increased again according to a specified, non-linear speed profile, which differs from the speed profile before the direction of travel is reversed, until the construction machine has reached the speed $V_2$, which is slower than speed $V_1$, at time $T_4$. The speed profile in FIG. 10A differs from the profiles in FIGS. 7A, 8A and 9A in that the reduction of the speed first takes place slowly and then increasingly faster.

In the present embodiment, the change from the working mode to the transport mode takes place during the time interval ΔT. The controller 22 controls the milling/mixing roller adjusting device at the time $T_2$ such that the milling/mixing roller 9 is raised from the bottom position (FIG. 4) into the upper position (FIG. 3) according to a predetermined profile. In the present embodiment, the milling/mixing roller 9 is raised at a constant speed so that the milling depth F decreases continuously. The milling/mixing roller 9 reaches the upper position at the time $T_3$ at which the construction machine begins to drive back in the opposite direction of travel (FIG. 10B).

While the milling/mixing roller 9 is raised, the controller 22 can control the milling/mixing roller adjusting device 16 in such a way that the roller flaps 12, 13 are pivoted from the position shown in FIG. 4 into the position shown in FIG. 3. However, the roller flaps 12, 13 can also only be adjusted to the position at least partially closing the roller housing when the milling/mixing roller 9 is already in the upper position.

Figure 11A:
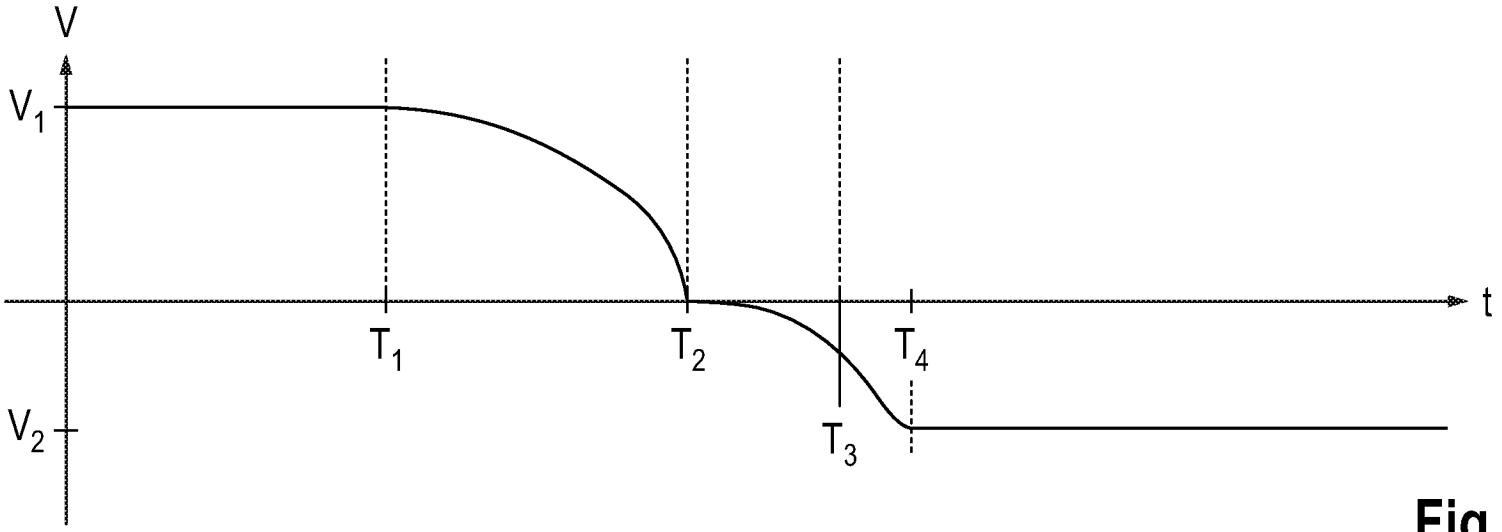
FIGS. 11A and 11B show a further embodiment of the movement of the construction machine during a reversal of the direction of travel with a change from a working mode to a transport mode.
Figure 11B:
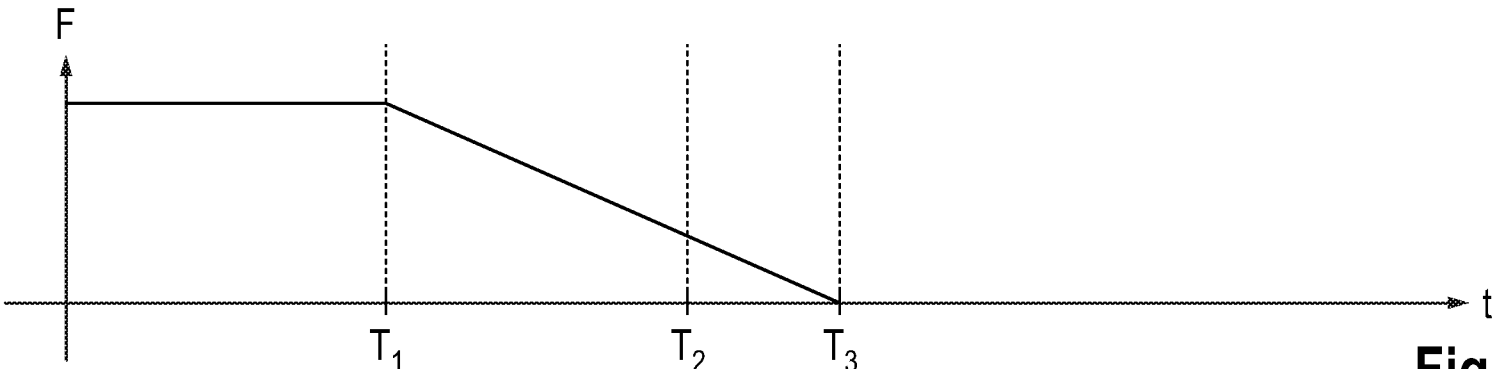

FIGS. 11A and 11B illustrate a further travel direction reversal control mode for a reversal of the direction of travel with a change from the working mode to the transport mode. This travel direction reversal control mode differs from the control mode according to FIGS. 10A and 10B in that the construction machine 1 does not stop for a predetermined time interval. The controller 22 accelerates the construction machine 1 at time $T_2$ back in the opposite direction of travel. The milling/mixing roller 9 is raised during the time interval $\Delta T=T_3-T_1$ during which the construction machine is decelerated and accelerated. While the milling/mixing roller 9 is being raised or after the milling/mixing roller 9 is already in the upper position, the roller flaps 12, 13 can once again be adjusted to the position at least partially closing the roller housing.

Figure 12A:
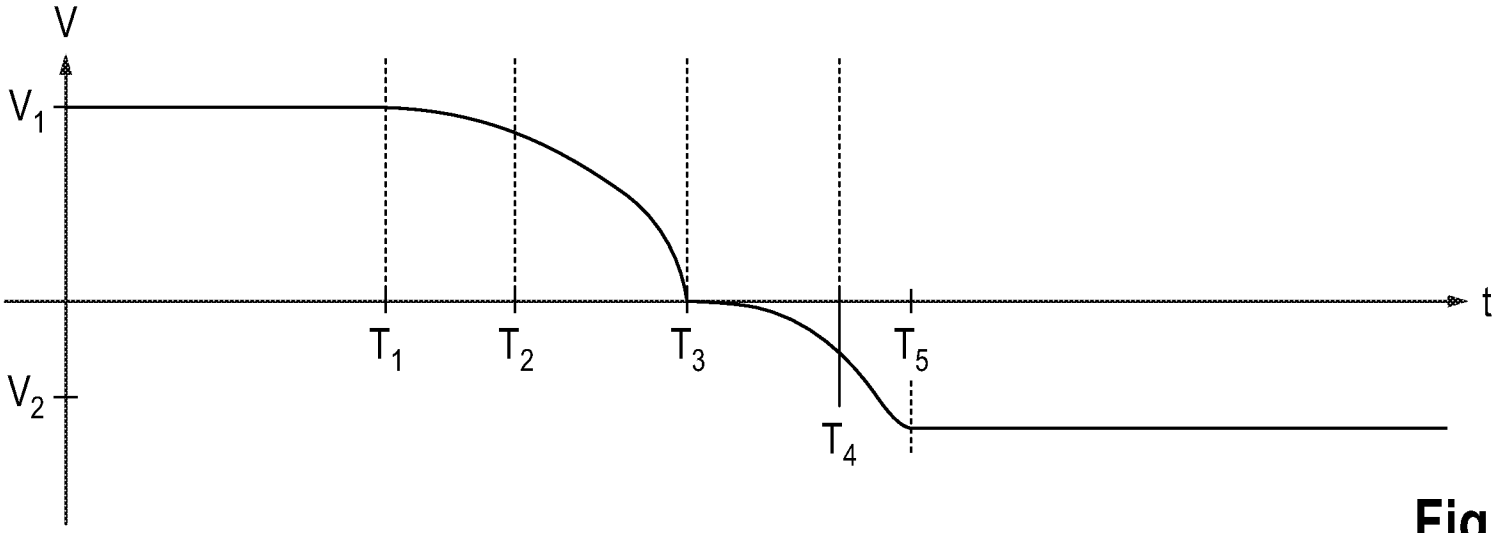
FIGS. 12A and 12B show a further embodiment of the movement of the construction machine during a reversal of the direction of travel with a change from a working mode to a transport mode.
Figure 12B:
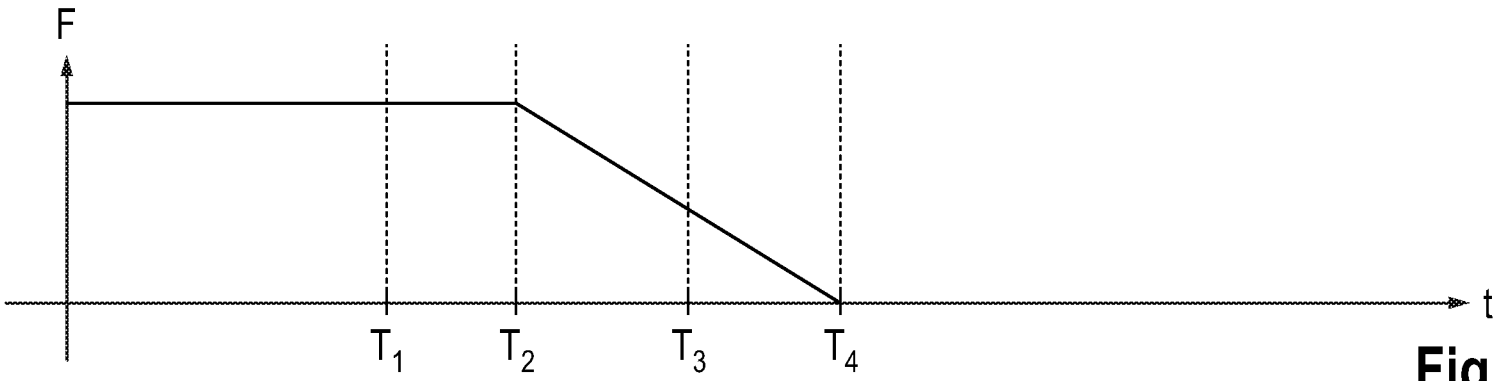

FIGS. 12A and 12B illustrate a further travel direction reversal control mode for a reversal of the direction of travel with a change from the working mode to the transport mode. This travel direction reversal control mode differs from the control mode according to FIGS. 11A and 11B in that the milling/mixing roller 9 is only raised at a later time $T_2$ according to a predetermined linear profile. Since the milling/mixing roller 9 is only raised later on, the constant speed at which the milling/mixing roller is raised is greater, which is expressed by a steeper curve.

Figure 13A:
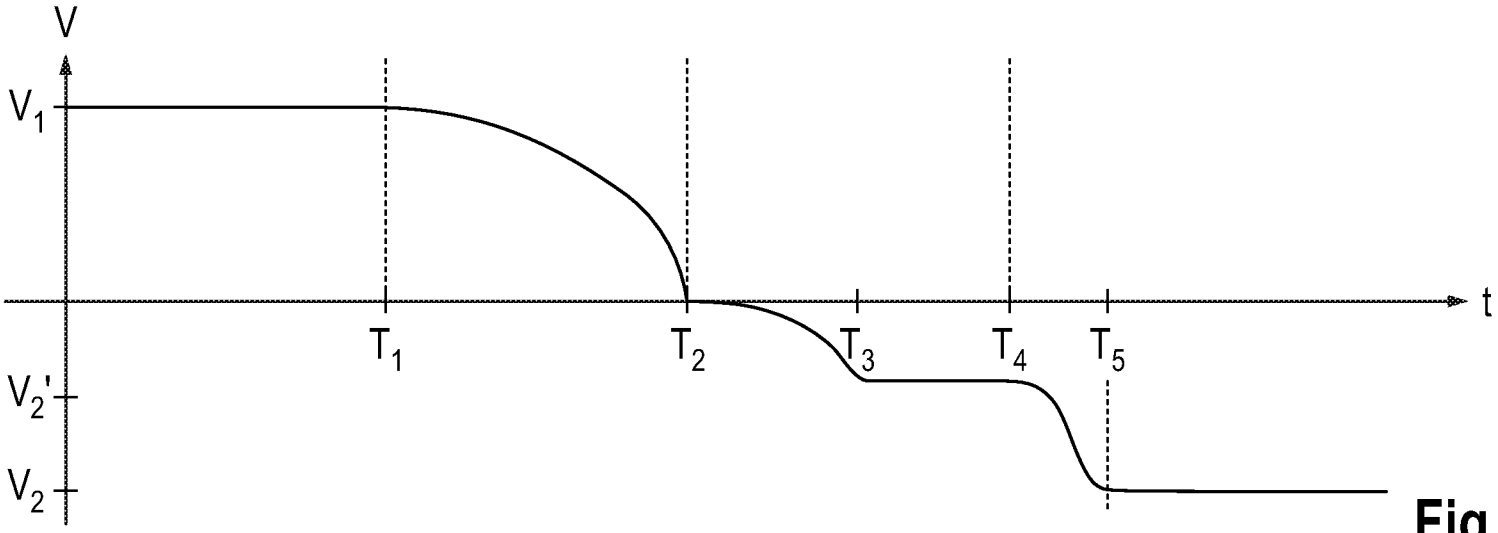
FIGS. 13A and 13B show a further embodiment of the movement of the construction machine during a reversal of the direction of travel with a change from a working mode to a transport mode.
Figure 13B:
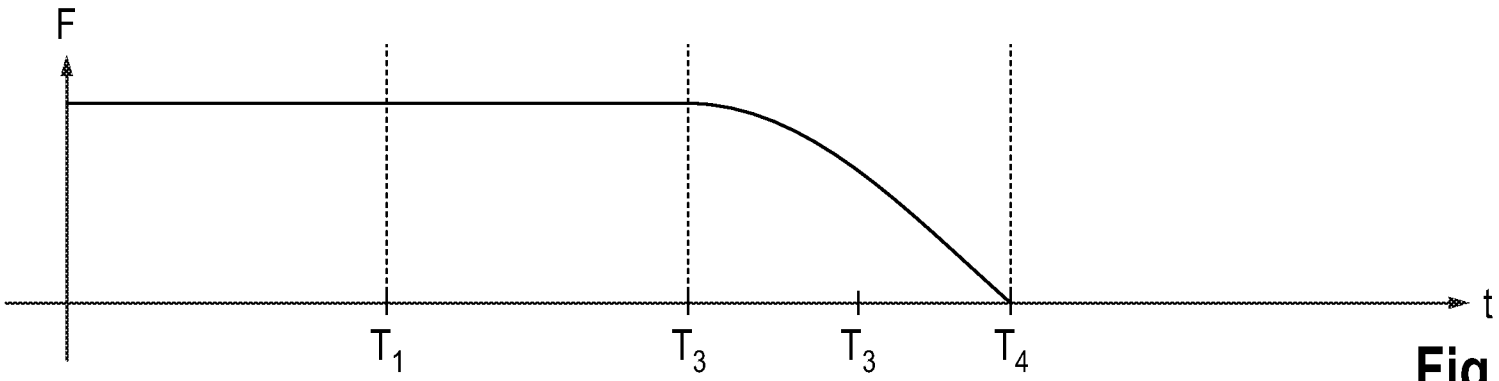

FIGS. 13A and 13B illustrate a further travel direction reversal control mode for a reversal of the direction of travel with a change from the working mode to the transport mode. The construction machine 1 initially travels at the speed $V_1$. At time $T_1$, the speed V is reduced according to a non-linear speed curve until the construction machine comes to a standstill at the time $T_2$. The drive device 21 then drives the wheels 2, 3 of the construction machine in the opposite direction of travel, wherein the speed of the construction machine is increased again according to a specified, non-linear speed profile, which differs from the speed profile before the reversal of the direction of travel, until the construction machine has reached the speed $V_2'$, which is slower than speed $V_1$, at time $T_3$. The speed is then kept constant until time $T_4$, whereupon the speed is re-increased to speed $V_2$ according to a non-linear speed curve until time $T_5$. During the time interval $\Delta T=T_3-T_2$, the milling/mixing roller 9 is raised according to a non-linear curve and raised during the time interval $\Delta T=T_4-T_3$ according to a linear curve. This embodiment is intended to illustrate that the milling/mixing roller can be controlled after the reversal of the direction of travel such that the axis of the milling/mixing roller moves on a predetermined trajectory while being lifted, which curve can be specified by the predefined profiles.

What is claimed is:

1. A self-propelled construction machine for working the ground, comprising:

a machine frame supported by wheels or crawler tracks resting on the ground;

a roller housing arranged on the machine frame, within which a rotatable milling/mixing roller for working the ground is provided, wherein a milling/mixing chamber of the roller housing is at least partially closable by a front roller flap facing in a main direction of travel and a rear roller flap facing in an opposite direction to the main direction of travel;

a roller flap adjusting device configured to adjust a position of the front roller flap and the rear roller flap;

a drive device configured to drive the wheels or crawler tracks;

a milling/mixing roller adjusting device configured to adjust a height of the milling/mixing roller relative to the ground and further relative to the machine frame;

a controller configured in a first driving mode to generate control signals to the drive device wherein the wheels or crawler tracks are driven such that the construction machine travels in a first direction of travel at a predetermined first speed;

the controller configured in a second driving mode to generate control signals to the drive device wherein the wheels or crawler tracks are driven such that the construction machine travels at a predetermined second speed in a second direction of travel which is opposite to the first direction of travel, the first direction of travel being a main direction of travel;

the controller is configured in a transport mode to control the milling/mixing roller adjusting device such that the milling/mixing roller is raised into an upper position in which the milling/mixing roller does not engage with the ground;

the controller is configured in a working mode to control the milling/mixing roller adjusting device such that the milling/mixing roller is lowered into a bottom position in which the milling/mixing roller engages with the ground;

wherein the controller is configured for automatic reversal of the direction of travel in such a way that, after receiving a travel direction reversal control signal while in the working mode, respective control signals are generated such that the drive device reduces the predetermined first speed at which the construction machine travels in the first direction of travel until the construction machine is stationary, and, after the construction machine is stationary, drives the wheels or crawler tracks in the opposite direction, the drive device increasing the speed in the second direction of travel up to the predetermined second speed, and the roller flap adjusting device adjusts the front and rear roller flap before the direction is reversed such that the front roller flap is in a raised position and the rear roller flap rests in a floating position on the ground, and after the direction has been reversed, the rear roller flap is in a raised position, and the front roller flap rests in a floating position on the ground.

2. The self-propelled construction machine of claim 1, wherein the first speed at which the construction machine moves in the first direction of travel is greater than the second speed at which the construction machine moves in the second direction of travel.

3. The self-propelled construction machine of claim 1, configured such that user input corresponding to the first speed and the second speed is received and stored in a memory unit, wherein the controller is configured to read out the values for the first speed and the second speed from the memory unit.

4. The self-propelled construction machine of claim 1, configured such that user input corresponding to the first speed is received and stored in a memory unit, wherein the controller is configured to calculate and store a value for the second speed from the value for the first speed according to a predefined functional relationship which is stored in the memory unit.

5. The self-propelled construction machine of claim 1, wherein the controller is configured such that, during a reversal of the direction of travel, the controller controls the milling/mixing roller adjusting device such that there is an automatic change from the working mode to the transport mode, or an automatic change from the transport mode to the working mode.

6. The self-propelled construction machine of claim 1, wherein the controller is configured to provide a first travel direction reversal control mode for a reversal of the direction of travel in the transport mode, wherein the controller controls the milling/mixing roller adjusting device such that a position of the milling and/or mixing roller is maintained during the reversal of the direction of travel and controls the roller flap adjusting device such that the position of the roller flaps is maintained during the reversal of the direction of travel.

7. The self-propelled construction machine of claim 1, wherein the controller is configured to provide a third travel direction reversal control mode for a reversal of the direction of travel with a change from the transport mode to the working mode, wherein the controller controls the milling/mixing roller adjusting device such that the milling/mixing roller is lowered from the upper position, in which the milling/mixing roller does not engage with the ground, into the bottom position in which the milling/mixing roller engages with the ground.

8. The self-propelled construction machine of claim 7, wherein the controller is configured to control the milling/mixing roller adjusting device in the third travel direction reversal control mode such that the milling/mixing roller is lowered at a predetermined speed, wherein the speed at which the milling/mixing roller is lowered remains constant over a distance covered by the construction machine, or a speed that changes over the distance covered by the construction machine.

9. The self-propelled construction machine of claim 7, wherein the controller is configured to control the roller flap adjusting device for the front and rear roller flap in the third travel direction reversal control mode such that the front roller flap is in a raised position after lowering the milling/mixing roller in the working mode, and the rear roller flap rests in a floating position on the ground, or the rear roller flap is in a raised position and the front roller flap rests in a floating position on the ground.

10. The self-propelled construction machine of claim 1, wherein the controller is configured to provide a fourth travel direction reversal control mode for a reversal of the direction of travel with a change from the working mode to the transport mode, wherein the controller controls the milling/mixing roller adjusting device such that the milling/mixing roller is raised from the lower position, in which the milling/mixing roller engages with the ground, into the upper position in which the milling/mixing roller does not engage with the ground, wherein the milling/mixing roller is raised at a predetermined speed, wherein the speed at which the milling/mixing roller is raised remains constant over a distance covered by the construction machine, or a speed that changes over the distance covered by the construction machine.

* * * * *